US010417959B2

(12) United States Patent
Hyun et al.

(10) Patent No.: US 10,417,959 B2
(45) Date of Patent: Sep. 17, 2019

(54) DISPLAY PANEL, A DISPLAY DEVICE, AND A METHOD OF DRIVING A DISPLAY PANEL

(71) Applicant: SAMSUNG DISPLAY CO., LTD., Yongin-si, Gyeonggi-Do (KR)

(72) Inventors: Chae-Han Hyun, Cheonan-si (KR); Min-Kyu Woo, Gwangmyeong-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 0 days.

(21) Appl. No.: 15/627,762

(22) Filed: Jun. 20, 2017

(65) Prior Publication Data

US 2017/0365212 A1 Dec. 21, 2017

(30) Foreign Application Priority Data

Jun. 20, 2016 (KR) ..... 10-2016-0076473

(51) Int. Cl.
*G09G 3/3225* (2016.01)
*G09G 3/20* (2006.01)
(Continued)

(52) U.S. Cl.
CPC ..... *G09G 3/3225* (2013.01); *G09G 3/2092* (2013.01); *G09G 3/3208* (2013.01);
(Continued)

(58) Field of Classification Search
CPC .. G09G 3/3208; G09G 3/3216; G09G 3/3255; G09G 3/3233; G09G 3/3242;
(Continued)

(56) References Cited

U.S. PATENT DOCUMENTS

2009/0225009 A1* 9/2009 Ka ..... G09G 3/3233 345/76
2010/0156875 A1* 6/2010 Kim ..... G09G 3/3233 345/211

(Continued)

FOREIGN PATENT DOCUMENTS

| | | |
|---|---|---|
| EP | 2736038 | 5/2014 |
| KR | 10-0739335 | 7/2007 |
| KR | 1020080013417 | 2/2008 |
| KR | 1020150003667 | 1/2015 |

OTHER PUBLICATIONS

Extended European Search Report dated Aug. 18, 2017 in corresponding European Patent Application No. 17176999.5.

*Primary Examiner* — Dong Hui Liang
(74) *Attorney, Agent, or Firm* — F. Chau & Associates, LLC

(57) ABSTRACT

A display panel includes a distributor to transfer a second data signal to a second data line in a first period of a data period and to transfer a first data signal to a first data line in a second period of the data period, the second period being different from the first period; a first pixel electrically connected to the first data line, to initialize a first previous data signal in the data period in response to a first control signal, and to store the first data signal in the second period in response a scan signal; and a second pixel electrically connected to the second data line and to store the second data signal in the first period in response to the scan signal.

23 Claims, 9 Drawing Sheets

(51) Int. Cl.

| | |
|---|---|
| ***G09G 3/3275*** | (2016.01) |
| ***G09G 3/3266*** | (2016.01) |
| ***G09G 5/00*** | (2006.01) |
| ***G09G 3/3208*** | (2016.01) |

(52) U.S. Cl.
CPC ..... *G09G 3/3266* (2013.01); *G09G 3/3275* (2013.01); *G09G 5/003* (2013.01); *G09G 2300/0426* (2013.01); *G09G 2300/0814* (2013.01); *G09G 2300/0861* (2013.01); *G09G 2310/0248* (2013.01); *G09G 2310/0251* (2013.01); *G09G 2310/0278* (2013.01); *G09G 2310/062* (2013.01); *G09G 2310/067* (2013.01); *G09G 2310/08* (2013.01)

(58) Field of Classification Search
CPC .... G09G 3/325; G09G 3/3258; G09G 3/3266; G09G 3/3275; G09G 3/3283; G09G 3/3291
See application file for complete search history.

(56) References Cited

U.S. PATENT DOCUMENTS

| | | | | |
|---|---|---|---|---|
| 2013/0215092 | A1* | 8/2013 | Wu ..... | G09G 3/3225 345/206 |
| 2014/0146030 | A1* | 5/2014 | Lee ..... | G09G 3/3208 345/212 |
| 2016/0210904 | A1 | 7/2016 | Na et al. | |

* cited by examiner

DISPLAY PANEL, A DISPLAY DEVICE, AND A METHOD OF DRIVING A DISPLAY PANEL

CROSS-REFERENCE TO RELATED APPLICATION(S)

This application claims priority under 35 U.S.C. § 119 to Korean Patent Application No. 10-2016-0076473, filed on Jun. 20, 2016 in the Korean Intellectual Property Office (KIPO), the disclosure of which is incorporated by reference herein in its entirety.

Technical Field

Exemplary embodiments of the present inventive concept relate to a display device. More particularly, exemplary embodiments of the present inventive concept relate to a display panel, a display device and a method of driving a display panel.

Description of the Related Art

A display device may include pixels electrically connected to data lines. The pixels may emit light based on data signals provided from a driving integrated circuit (e.g., a driving IC, a data driver, etc.) through the data lines.

A display device may distribute the data signals using a de-multiplexer (or, demultiplexer). In this case, the display device may start a scanning operation after the data signals are distributed. This may prevent a current data signal a data signal remaining in the data line from being mixed. However, this may cause a scan time for each of the pixels to be shortened, and thus, a stain may occur in a displayed image.

SUMMARY

According to an exemplary embodiment of the present inventive concept, a display panel may include a distributor configured to transfer a second data signal to a second data line in a first period of a data period and to transfer a first data signal to a first data line in a second period of the data period, wherein the second period is different from the first period; a first pixel electrically connected to the first data line, configured to initialize a first previous data signal in the data period in response to a first control signal, and configured to store the first data signal in the second period in response a scan signal; and a second pixel electrically connected to the second data line and configured to store the second data signal in the first period in response to the scan signal.

In an exemplary embodiment of the present inventive concept, the first control signal may be an N+1th gate signal, where N is a positive integer.

In an exemplary embodiment of the present inventive concept, the first pixel and the second pixel may be included in a Nth pixel row, and the first control signal may correspond to an N+1th pixel row adjacent to the Nth pixel row.

In an exemplary embodiment of the present inventive concept, the first pixel may include a transistor electrically connected between the first data line and a first voltage and configured to be turned on in response to the first control signal.

In an exemplary embodiment of the present inventive concept, the first pixel may further include a first light emitting element; a first storage capacitor; a second transistor for transferring a signal of the first data line to the first storage capacitor in response to the scan signal; and a first transistor for controlling an amount of a first current provided to the first light emitting element with a voltage charged in the first storage capacitor.

In an exemplary embodiment of the present inventive concept, the second pixel may include a second light emitting element; a second storage capacitor; a fourth transistor electrically connected between a terminal of the second storage capacitor and the first voltage and configured to be turned on in response to a second control signal; a twelfth transistor for transferring the second data signal to the second storage capacitor in response to the scan signal; and a sixth transistor for controlling an amount of a second current provided to the second light emitting element with a voltage in the second storage capacitor.

In an exemplary embodiment of the present inventive concept, the fourth transistor may be turned on in an initialization period in response to the second control signal, and the initialization period may be different from the data period.

In an exemplary embodiment of the present inventive concept, the distributor may include a source bump configured to receive the first data signal and the second data signal from an external component; a first switch electrically connected between the source bump and the first data line and configured to be turned on in the second period in response to a first switch control signal; and a second switch electrically connected between the source bump and the second data line and configured to be turned on in the first period in response to a second switch control signal.

In an exemplary embodiment of the present inventive concept, the second control signal may be provided to the second pixel at a first time point which is earlier than the data period, the scan signal may be provided to the first pixel and the second pixel at a second time point which is later than a start point of the first period, the first control signal may be provided to the first pixel from the second time point to a third time point, and the third time point may be earlier than the second period.

In an exemplary embodiment of the present inventive concept, the data period may include the second time point.

In an exemplary embodiment of the present inventive concept, the first pixel may further include a seventh transistor electrically connected between a terminal of the first storage capacitor and the first voltage and configured to be turned on in response to the second control signal.

In an exemplary embodiment of the present inventive concept, the display panel may further include a third pixel electrically connected to a third data line, configured to initialize a third previous data signal in the data period in response to the first control signal, and configured to store a third data signal in a third period of the data period in response to the scan signal. Here, the third period may be different from the first period and the second period, and the distributor may transfer the third data signal to the third data line in the third period.

In an exemplary embodiment of the present inventive concept, the first pixel, the second pixel, and the third pixel may be included in an Nth pixel row, and the first control signal may correspond to an N+1th pixel row adjacent to the Nth pixel row.

In an exemplary embodiment of the present inventive concept, the third pixel may include a third light emitting element; a third storage capacitor; a transistor electrically connected between the third data line and a first voltage and configured to be turned on in response to the first control signal; a first transistor for transferring a signal of the third data line to the third storage capacitor in response to the scan signal; and a second transistor for controlling an amount of a third current provided to the third light emitting element with a voltage charged in the third storage capacitor.

In an exemplary embodiment of the present inventive concept, the scan signal may be provided to the first pixel and the second pixel at a second time point which is later than a start point of the first period, the first control signal may be provided to the first pixel from the second time point to a third time point, and the third time point may be earlier than the second period.

According to an exemplary embodiment of the present inventive concept, a display device may include a display panel; a scan driver configured to provide a first control signal, a second control signal and a scan signal to the display panel; and a data driver configured to sequentially provide a first data signal and a second data signal to the display panel. Here, the display panel may include a distributor configured to transfer a second data signal to a second data line in a first period of a data period and to transfer a first data signal to a first data line in a second period of the data period, wherein the second period is separate from the first period; a first pixel electrically connected to the first data line, configured to initialize a first previous data signal in the data period in response to the first control signal, and configured to store the first data signal in the second period in response the scan signal; and a second pixel electrically connected to the second data line, configured to initialize a second previous data signal in response to the second control signal, and configured to store the second data signal in the first period in response to the scan signal.

According to an exemplary embodiment of the present inventive concept, a method of driving a display panel which includes a first pixel, a second pixel, and a distributor for sequentially providing first and second data signals to the first and second pixels, may include: initializing the second pixel in response to a second control signal; providing a second data signal to the second pixel using the distributor; initializing the first pixel in response to a first control signal and the scan signal in response to the second data signal being provided to the second pixel; and providing the first data signal to the first pixel using the distributor.

In an exemplary embodiment of the present inventive concept, the first pixel may include a transistor electrically connected between the first data line and a first voltage and configured to be turned on in response to the first control signal.

In an exemplary embodiment of the present inventive concept, the first pixel is pre-initialized while the second pixel is initialized.

In an exemplary embodiment of the present inventive concept, the scan signal is provided to the first pixel and the second pixel when the second data signal is provided to the second pixel.

According to an exemplary embodiment of the present inventive concept, a display panel may include: a first pixel electrically connected to a first data line and including a transistor having a first electrode connected to the first data line, a second electrode connected to a voltage and a gate electrode connected to an N+1 gate signal line, wherein N is a positive integer; and a second pixel electrically connected to a second data line and configured to store a second data signal provided via the second data line in a first period of a data period in response to a scan signal, wherein the first pixel is configured to be initialized in the data period in response to a control signal provided to the gate electrode of the transistor via the N+1 gate signal line, and store a first data signal provided via the first data line in a second period of the data period in response to the scan signal.

In an exemplary embodiment of the present inventive concept, the display panel may further include a distributor configured to provide the first and second data signals to the first and second pixels.

In an exemplary embodiment of the present inventive concept, the distributor may include a demultiplexer.

In an exemplary embodiment of the present inventive concept, the first period of the data period may occur before the second period of the data period.

In an exemplary embodiment of the present inventive concept, the data period may be overlapped with an initialization period and a scan period.

In an exemplary embodiment of the present inventive concept, the first period of the data period may occur before a scan period starts and the second period of the data period may occur before the scan period ends.

In an exemplary embodiment of the present inventive concept, the scan period may begin when the control signal is provided to the gate electrode of the transistor.

In an exemplary embodiment of the present inventive concept, the first and second pixels may be arranged in a first row, and the control signal may be a gate signal of a second row adjacent to the first row.

In an exemplary embodiment of the present inventive concept, data previously stored in the first pixel may be removed when the first pixel is initialized.

BRIEF DESCRIPTION OF THE DRAWINGS

The above and other features of the present inventive concept will become more apparent by describing in detail exemplary embodiments thereof with reference to the accompanying drawings.

DETAILED DESCRIPTION OF THE EMBODIMENTS

Hereinafter, exemplary embodiments of the present inventive concept will be explained in detail with reference to the accompanying drawings.

Figure 1:
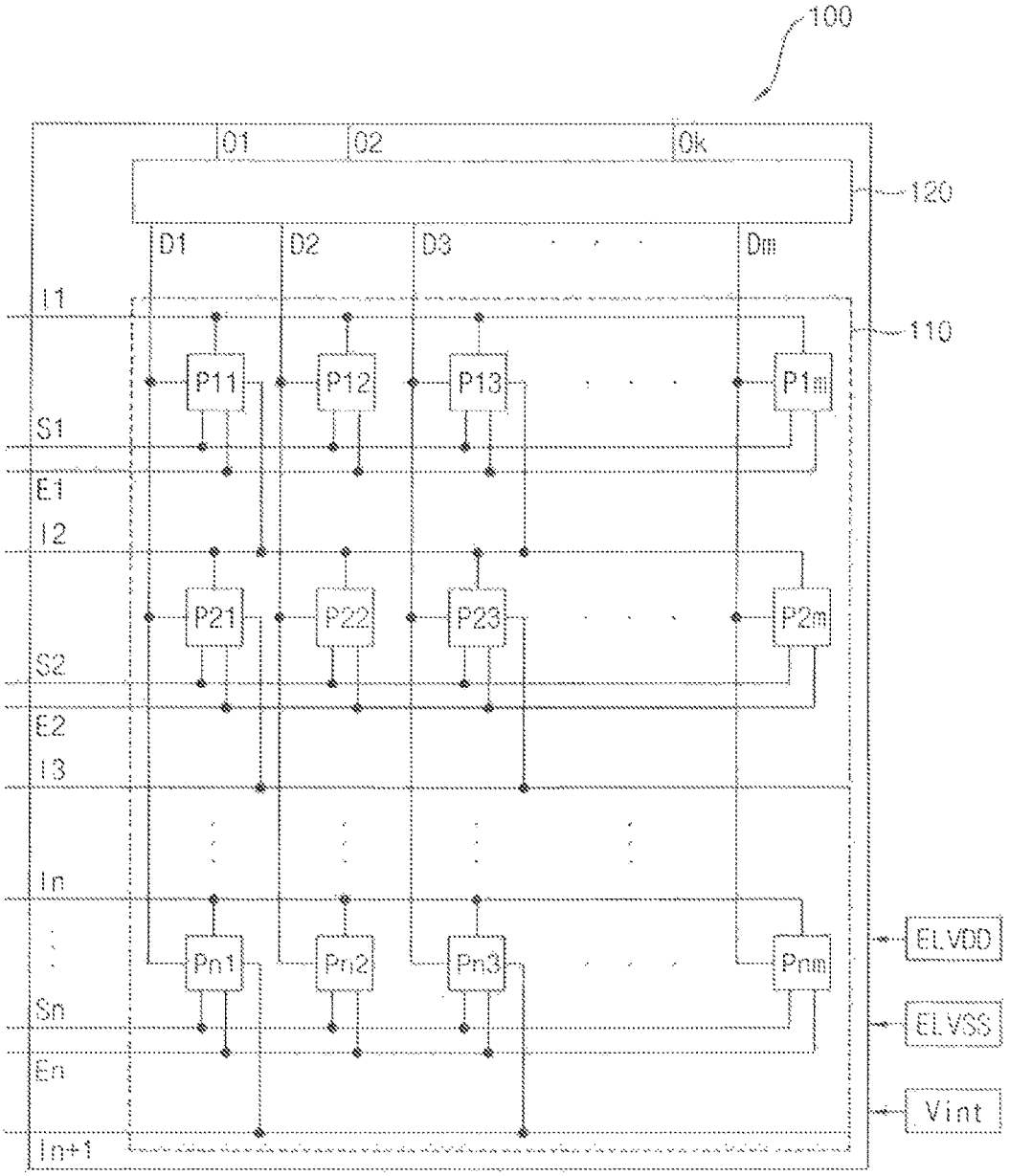
FIG. 1 is a block diagram illustrating a display panel according to an exemplary embodiment of the present inventive concept.

FIG. 1 is a block diagram illustrating a display panel according to an exemplary embodiment of the present inventive concept.

Referring to FIG. 1, the display panel 100 may include data lines D1 through Dm, scan lines S1 through Sn, light emission control signal lines E1 through En, gate signal lines I1 through In+1, a display region 110, and a distributor 120. Each of m and n is a positive integer, for example.

The distributor 120 may distribute data signals provided from an external component (e.g., a driving integrated circuit, data driver, etc.) through output lines O1 through Ok. k is a positive integer, for example. For example, the distributor 120 may include a 1:3 demultiplexer and may provide three data signals provided through a first output line O1 during a data period to first through third data lines D1 through D3. In other words, the distributor 120 may be a device that takes a single input line and routes it to one of several output lines.

For example, when the display panel 100 (or, a display device) includes the distributor 120, a number of the output lines O1 through Ok electrically connected to the external component may be reduced. Therefore, a number of driving circuits included in the external component (or, a number of channels of the external component) may be reduced. Therefore, a manufacturing cost of a display device including the display panel 100 may be reduced.

The display region 110 may include pixels P11 through Pnm which are located in a cross-region (or, intersection region) of the data lines D1 through Dm, the gate signal lines I1 through In+1, the scan lines S1 through Sn, and the light emission control signal lines E1 through En. For example, a row of the pixels P11 to P1*m* may be disposed between gate signal line I1 and scan line S1. A column of the pixels P11 to Pn1 may be disposed between data lines D1 and D2, for example.

The pixels P11 through Pnm may store data signals (e.g., data signals provided through the data lines D1 through Dm) in response to a scan signal (e.g., a scan signal provided through the scan lines S1 through Sn). The pixels P11 through Pnm may emit light with a luminance corresponding to the data signals in response to a light emission control signal (e.g., a light emission control signal provided through the light emission control signal lines E1 through En).

In an exemplary embodiment of the present inventive concept, the display region 110 may include the pixels P11 through Pnm which are arranged in a pentile form. For example, an eleventh pixel P11 may emit light with a first color (e.g., a red color) and a twelfth pixel P12 may emit light with a second color (e.g., a green color). A twenty-first pixel P21 may emit light with a third color (e.g., a blue color) and a twenty-second pixel P22 may emit light with the second color. In other words, a pixel emitting light with the first color and a pixel emitting light with the third color may be alternatively arranged in a first pixel column (e.g., a pixel column between the first data line D1 and the second data line D2) and a pixel emitting light with the second color and a pixel emitting light with the second color may be arranged in a second pixel column (e.g., a pixel column between the second data line D2 and the third data line). Hereinafter, pixels included in a odd-numbered pixel column (e.g., the eleventh pixel P11, a thirteenth pixel P13, the twenty-first pixel P21, etc.) are referred to as a first pixel and pixels included in an even-numbered pixel column (e.g., the twelfth pixel P12, a fourteenth pixel P14, the twenty-second pixel P22, etc.) are referred to as a second pixel.

In an exemplary embodiment of the present inventive concept, the second pixel may initialize a second previous data signal in response to a second control signal in an initialization period and may store a second data signal in response to the scan signal in a first period of a data period. The first pixel may initialize a first previous data signal in response to a first control signal in the data period (e.g., in the first period of the data period or before a second period of the data period) and may store a first data signal in response to the scan signal in the second period of the data period.

Here, the first pixel and the second pixel may be included in an Nth pixel row and the first pixel may be adjacent to the second pixel. N is a positive integer, for example. The second control signal may be an Nth gate signal corresponding to the Nth pixel row (e.g., a first pixel row), and the first control signal may be an N+1th gate signal corresponding to an N+1th pixel row (e.g., a second pixel row adjacent to the first pixel row). The first previous data signal may be a data signal stored in the first pixel in a previous frame (or, a data signal remaining in a data line connected to the first pixel), and the second previous data signal may be a data signal stored in the second pixel in a previous frame (or, a data signal remaining in a data line connected to the second pixel). The data period may be allocated for providing the data signals to pixels in the Nth pixel row (e.g., pixels P11 through P1*m*) by the distributor 120 and may include the first period and the second period. The initialization period may be allocated for initializing the first and second previous data signals and may be allocated earlier than the data period. In other words, the initialization period may occur prior to the data period.

As illustrated in FIG. 1, the twelfth pixel P12 may receive the second control signal (e.g., a first gate signal transferred through the first gate signal line I1) and may initialize the second previous data signal in response to the second control signal in the initialization period. The eleventh pixel P11 may receive the first control signal (e.g., a second gate signal transferred through the second gate signal line I2) and may initialize the first previous data signal in response to the first control signal in the data period.

During a frame, a conventional display device sequentially performs an initialization operation to initialize pixels using a control signal (e.g., a gate signal) in an initialization period, a distribution operation to distribute data signals to data lines using a distributor, and a writing operation to store the data signals in pixels using a scan signal, for example. A display device including the display panel according to an exemplary embodiment of the present inventive concept may simultaneously (or, concurrently) perform a writing operation for the second pixel and an initialization operation for the first pixel. Therefore, the display panel may increase a writing time (e.g., a scan time, or a scan on time) for a certain pixel (e.g., the second pixel) and may reduce (or, eliminate) a stain that may occur in a short write time.

Figure 2:
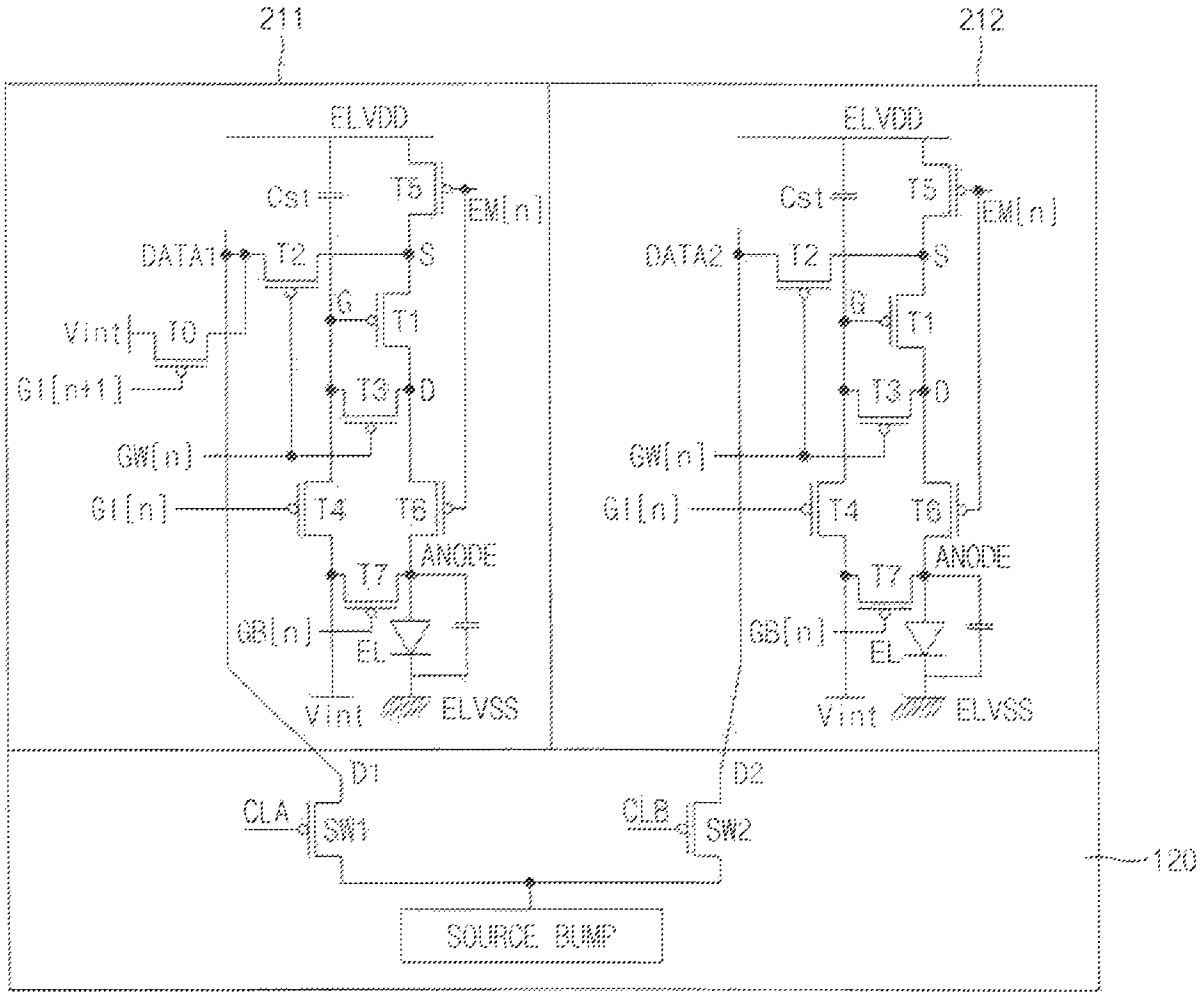
FIG. 2 is a circuit diagram illustrating the display panel of FIG. 1 according to an exemplary embodiment of the present inventive concept.

FIG. 2 is a circuit diagram illustrating the display panel of FIG. 1 according to an exemplary embodiment of the present inventive concept.

Referring to FIGS. 1 and 2, the first pixel 211 may include a first light emission element EL, a first storage capacitor Cst, a zeroth (0th) transistor T0 (e.g., an initialization transistor), and first through seventh transistors T1 through T7. In other words, the first pixel 211 may further include the zeroth transistor with respect to a pixel having a pixel structure of 7T1C (e.g., seven transistors T1-T7 and one capacitor Cst).

The first light emission element EL may be electrically connected between a first power voltage ELVDD (or, a fourth node Anode) and a second power voltage ELVSS and may emit light based on a first driving current flowing through the fourth node Anode. Here, the first power voltage ELVDD and the second power voltage ELVSS may be provided from an external component (e.g., a power supply), and a first voltage level of the first power voltage ELVDD may be higher than a second voltage level of the second power voltage ELVSS. For example, the first light emission element EL may be an organic light emitting diode.

The zeroth transistor T0 may include a first electrode electrically connected to a first data line D1, a second electrode electrically connected to a third voltage Vint, and a gate electrode for receiving an N+1th gate signal GI[n+1]. The zeroth transistor T0 may transfer the third voltage Vint to the first data line D1 in response to the N+1th gate signal GI[n+1].

The second transistor T2 may include a first electrode electrically connected to the first data line D1, a second electrode electrically connected to a first node S, and a gate electrode for receiving a scan signal GW[n]. The second transistor T2 may transfer a signal of the first data line D1 (e.g., a first data signal DATA1 or the third voltage Vint) to the first node S in response to the scan signal GW[n].

The first transistor T1 may include a first electrode electrically connected to the first node S, a second electrode electrically connected to a second node D, and a gate electrode electrically connected to a third node G. The first transistor T1 may control an amount of current which flows to the first light emission element EL in response to a third node voltage of the third node G (or, a voltage charged in the first storage capacitor Cst).

The third transistor T3 may include a first electrode electrically connected to the second node D, a second electrode electrically connected to the third node G, and a gate electrode for receiving the scan signal GW[n]. The third transistor T3 may electrically connect the second node D to the third node G in response to the scan signal GW[n].

The first storage capacitor Cst may be electrically connected between the first power voltage ELVDD and the third node G and may store a signal transferred through the first through third transistors T1 through T3 (e.g., the first data signal DATA1 or the third voltage Vint).

The fourth transistor T4 may include a first electrode electrically connected to the third voltage Vint, a second electrode electrically connected to the third node G, and a gate electrode for receiving the Nth gate signal GI[n] (e.g., a first gate signal). The fourth transistor T4 may transfer the third voltage Vint to the first storage capacitor Cst in response to the Nth gate signal GI[n]. A signal stored in the first capacitor Cst may be initialized (or, removed) by the third voltage Vint.

The fifth transistor T5 may include a first electrode electrically connected to the first power voltage ELVDD, a second electrode electrically connected to the first node S, and a gate electrode for receiving a light emission control signal EM[n]. The sixth transistor T6 may include a first electrode electrically connected to the second node D, a second electrode electrically connected to the fourth node Anode, and a gate electrode for receiving the light emission control signal EM[n]. The fifth transistor T5 and the sixth transistor T6 may form a current path between the first power voltage ELVDD and the first light emission element EL in response to the light emission control signal EM[n].

The seventh transistor T7 may include a first electrode electrically connected to the fourth node Anode, a second electrode electrically connected to the third voltage Vint, and a gate electrode for receiving a compensation control signal GB[n]. The seventh transistor T7 may provide the third voltage Vint to the fourth node Anode in response to the compensation control signal GB[n].

The second pixel 212 may be substantially the same as the first pixel 211 except that it does not include the zeroth transistor T0 and that it is connected to the second data line D1. Therefore, a duplicated explanation will not be provided.

The distributor 120 may include a source bump SOURCE BUMP, a first switch SW1, and a second switch SW2. The source bump SOURCE BUMP (e.g., an electrode, or a pad) may receive the first and second data signals DATA1 and DATA2 provided from an external component (e.g., a driving integrated circuit). The first switch SW1 may be electrically connected between the source bump SOURCE BUMP and the first data line D1 and may transfer the first data signal DATA1 to the first data line D1 in response to the a first switch control signal CLA. The second switch SW2 may be electrically connected between the source bump SOURCE BUMP and the second data line D2 and may transfer the second data signal DATA2 to the second data line D2 in response to the a second switch control signal CLB.

It is illustrated in FIG. 2 that each of the first and second pixels 211 and 212 has a pixel structure of 7T1C. However, the first and second pixels 211 and 212 are not limited thereto. For example, the first pixel 211 may further include the zeroth transistor T0 with respect to a pixel structure of 3T1C (e.g., three transistors and one capacitor). For example, the first pixel 211 may include the first light emission element EL, the first storage capacitor Cst, the zeroth transistor T0, the first transistor T1, and a switching transistor (e.g., a transistor which is electrically connected between the first data line D1 and the third node G and which transfers a signal of the first data line D1 to the third node G).

Figure 3A:
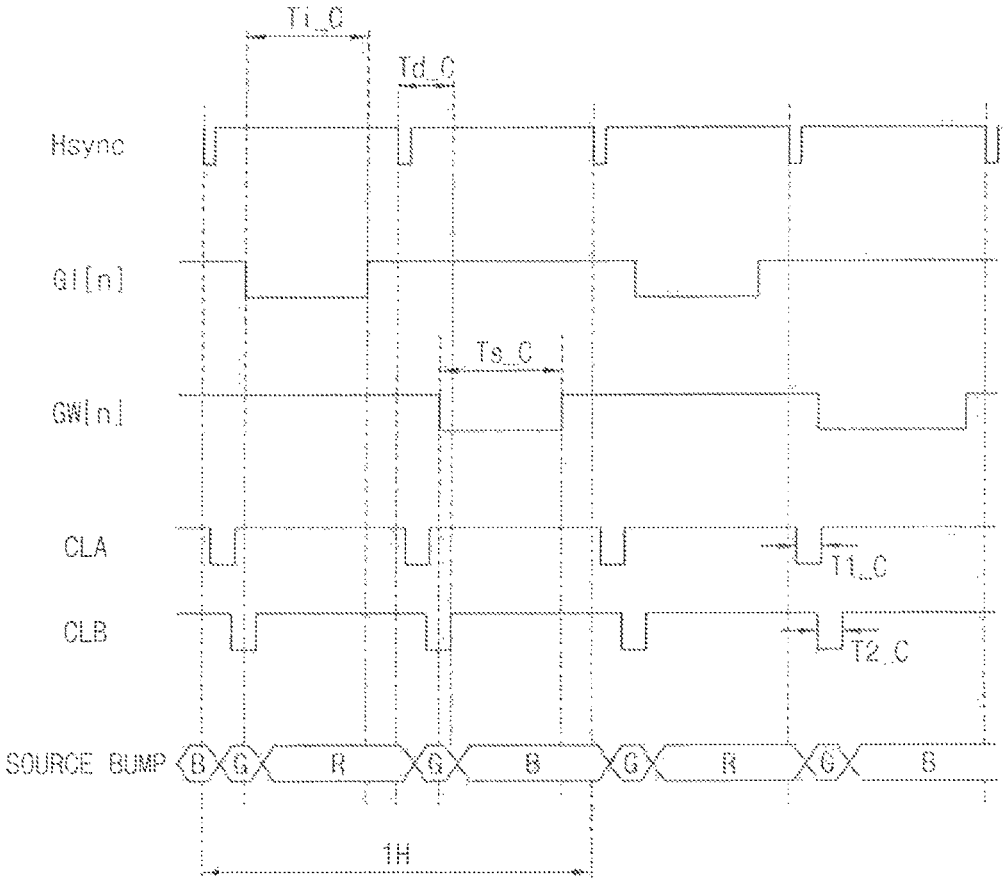
FIG. 3A is a waveform diagram illustrating a conventional technique of providing signals to the display panel of FIG. 2.
Figure 3B:
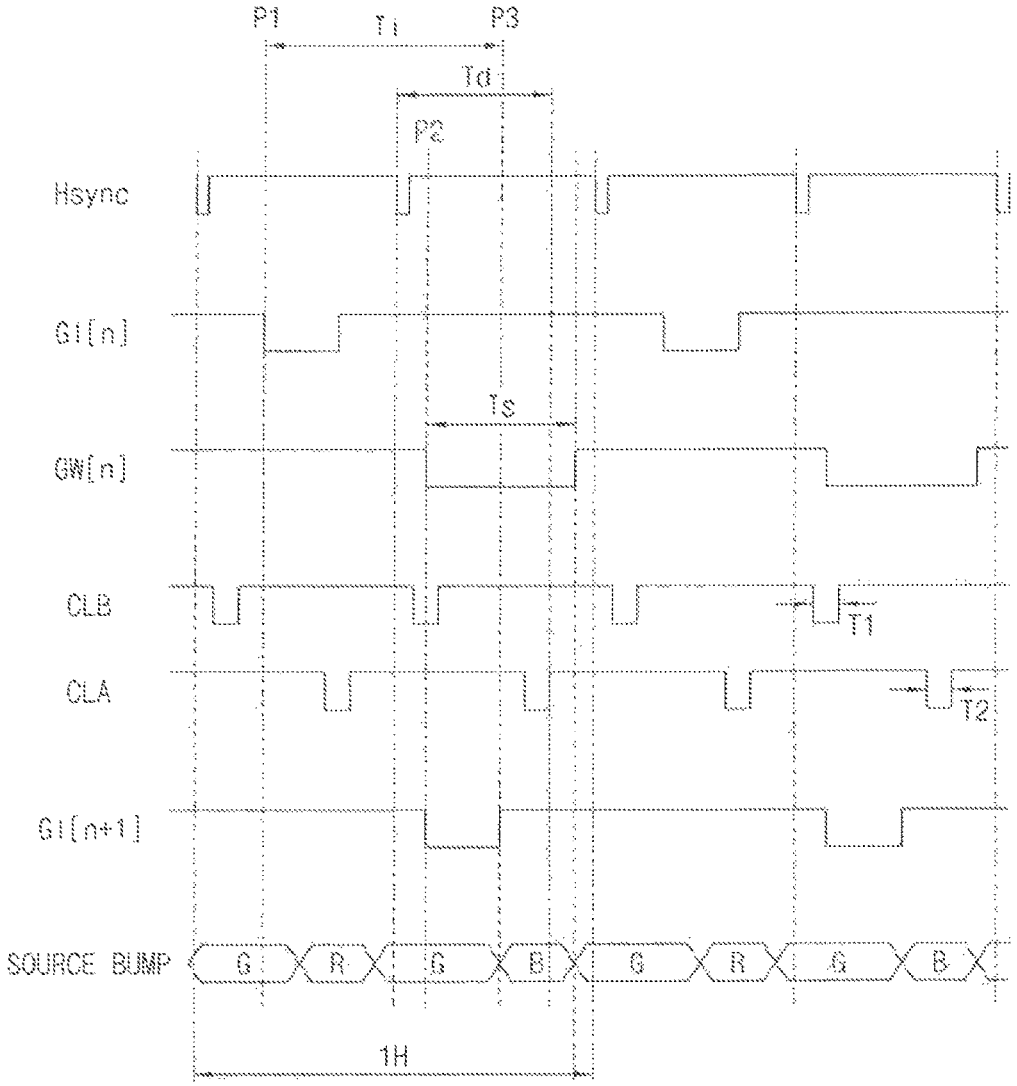
FIG. 3B is a waveform diagram illustrating an inventive technique of providing signals to the display panel of FIG. 2.

FIG. 3A is a waveform diagram illustrating a conventional technique of providing signals to the display panel of FIG. 2. FIG. 3B is a waveform diagram illustrating an inventive technique of providing signals to the display panel of FIG. 2.

Referring to FIGS. 2 and 3A, each of the Nth gate signal GI[n], the scan signal GW[n], and the first and second switch control signals CLA and CLB may have a waveform which occurs once or more than once within a period of a horizontal time 1H (or, a frame). Here, the horizontal time 1H may include a comparison initialization period Ti_C, a comparison data period Td_C, and a comparison scan time Ts_C. The comparison initialization period Ti_C, the comparison data period Td_C, and the comparison scan time Ts_C may be allocated sequentially and may not be overlapped with each other.

A synchronization signal Hsync may be a reference signal to control (or, synchronize) operation timings of control signals (e.g., the Nth gate signal GI[n], etc).

In the comparison initialization period Ti_C, the Nth gate signal GI[n] may have a logic low level. In this case, the first pixel 211 and the second pixel 212 may initialize previous data signals (e.g., data signals which are respectively stored in the first and second pixels 211 and 212 in a previous frame) based on the Nth gate signal GI[n], respectively.

In the comparison data period Td_C, the second switch control signal CLB and the first switch control signal CLA may have a logic low level. The first switch control signal CLA may have the logic low level in a first comparison period T1_C of the comparison data period Td_C, and the second switch control signal CLB may have the logic low level in a second comparison period T1_C of the comparison data period Td_C. Here, the distributor 120 may transfer the second data signal DATA2 to the second data line D2 in the second comparison period T2_C and may transfer the first data signal DATA1 to the first data line D1 in the first comparison period T1_C.

The first data signal DATA1 (e.g., a red (R) data or a blue (B) data) and the second data signal DATA2 may be provided to the source bump SOURCE BUMP of the distributor 120 corresponding to the first and second switch control signals CLA and CLB.

In the comparison scan period Ts_C, the scan signal GW[n] may have the logic low level. In this case, the second pixel 212 may store the second data signal DATA2 transferred through the second data line D2, and the first pixel 211 may store the first data signal DATA1 transferred through the second data line D1.

For example, to prevent the first and second data signals DATA1 and DATA2 from being mixed with previous data signals (e.g., data signals stored in the first and second data lines D1 and D2 and/or the first and second pixels 211 and 212 in a previous frame), the first and second data signals DATA1 and DATA2 may be respectively transferred to the first and second data lines D1 and D2 before the scan signal GW[n] has the logic low level. However, when a resolution of the display panel 100 is high, and the comparison data period Td_C and the comparison scan period Ts_C are short, a stain may occur on a displayed image due to a reduction of the comparison scan period Ts_C.

The display panel 100 according to an exemplary embodiment of the present inventive concept may include the first pixel 211 and the second pixel 212. In this case, a data period Td may be overlapped with a scan period Ts, therefore the display panel 100 may ensure that the scan period Ts is sufficient.

Referring to FIGS. 2, 3A, and 3B, a synchronization signal Hsync and an Nth gate signal GI[n] illustrated in FIG. 3B may be the same as or substantially the same as the synchronization signal Hsync and the Nth gate signal GI[n] illustrated in FIG. 3A. Therefore, a duplicate description will not be provided.

A horizontal time 1H illustrated in FIG. 3B may include an initialization period Ti, a data period Td, and a scan period Ts. The initialization period Ti, the data period Td, and the scan period Ts may be overlapped with each other.

The Nth gate signal GI[n] may be changed to a logic low level (e.g., a turn-on voltage level, or a low voltage level) at a period time point P1 and may be changed to a logic high level (e.g., a turn-off voltage level, or a high voltage level) before the data period Td is started.

In this case, the second pixel 212 may initialize a second previous data signal in response to the Nth gate signal GI[n]. Similarly, the first pixel 211 may initialize a first previous data signal in response to the Nth gate signal GI[n].

For example, the first pixel 211 may initialize the first previous data signal in response to the N+1th gate signal GI[n+1] at a second time point P2 described below. However, the initialization of the first previous data signal may be abnormal because an initialization time at the second time point P2 is changed (e.g., shortened). Therefore, the first pixel 211 may normally initialize the first previous data signal (e.g., a data signal stored in the first storage capacitor Cst of the first pixel 211 in a previous frame) in response to the Nth gate signal GI[n]. This may prevent the first previous data signal (e.g., a data signal remaining in the first data line D1 in a previous frame) from being stored in the first pixel 211 at the second time point P2.

In the data period Td, the second switch control signal CLB and the first switch control signal CLA may have the logic low level. The second switch control signal CLB may have the logic low level in a first period T1 of the data period Td, and the first switch control signal CLA may have the logic low level in a second period T2 of the data period Td.

In this case, the distributor 120 may transfer the second data signal DATA2 to the second data line D2 in the first period T1 and may transfer the first data signal DATA1 to the first data line D1 in the second period T2.

At the second time point P2, the scan period Ts may be started, and the scan signal GW[n] may have the logic low level during the scan period Ts. The second time point P2 may be included in the first period T1 of the data period Td, may be a time point shortly after the first period T1 is started, or may be a time point shortly before/after the first period T1 is finished. When the second time point P2 is included in the first period T1, the scan period Ts may be ensured sufficiently.

In the scan period Ts, the second pixel 212 may store the second data signal DATA2 transferred through the second data line D2. Similarly, the first pixel 211 may store the first data signal DATA1 transferred through the first data line D1. However, the first pixel 211 may store the first previous data signal (e.g., a data signal remaining on the first data line D1 in a previous frame) because the first data signal DATA1 is not transferred to the first data line D1 according to the first switch control signal CLA.

Therefore, the display panel 100 according to an exemplary embodiment of the present inventive concept may prevent the first previous data signal from being stored in the first pixel 211 using the N+1th gate signal GI[n+1].

As illustrated in FIG. 3B, the N+1th gate signal GI[n+1] may have the logic low level during the second time point P2 through a third time point P3. When the N+1th gate signal GI[n+1] has the logic low level, the zeroth transistor T0 of the first pixel 211 may be turned on and the third voltage Vint may be provided to the first data line D1. Therefore, even though the scan signal GW[n] has the logic low level, the first pixel 211 may not store the first previous data signal and may initialize the first previous data signal using the third voltage Vint provided through the zeroth transistor T0.

The N+1th gate signal GI[n+1] may has a phase which is delayed by a certain time with respect to the Nth gate signal GI[n]. In the display panel 100 illustrated in FIG. 1, a scanning operation may be sequentially performed from the first pixel row to an nth pixel row. Similarly, an initialization operation may be sequentially performed from the first pixel row to an nth pixel row. Therefore, the N+1th gate signal GI[n+1] (e.g., a second gate signal) may have a phase delayed with respect to the nth gate signal GI[n] (e.g., a first gate signal) provided to a previous pixel row. For example, the gate signal of a low row may have its phase delayed with respect to the gate signal of a high row.

After the third time point P3, the first switch control signal CLA may have the logic low level during a latter portion of the data period Td. The distributor 120 may transfer the first data signal DATA1 to the first data line D1, and the first pixel 211 may store the first data signal DATA1 in response to the scan signal GW[n] having the logic low level.

In an exemplary embodiment of the present inventive concept, the third time point P3 may be set (or determined) based on a writing time of the second data signal DATA2 (e.g., a scan on time of the second pixel 212). The third time point P3 may be set for data signals provided to the source bump SOURCE BUMP of the distributor 120 illustrated in FIG. 3B (or data signals sequentially output through the distributor 120) to have writing times whose sizes are mutually similar or for a wiring time of the second data signal DATA2 to be greater than a writing time of the first data signal DATA1.

The display panel 100 may prevent a stain that occurs on a displayed image, because the data period Td and the scan period Ts of FIG. 3B are respectively greater than the comparison data period Td_C and the comparison scan period Ts_C described with reference to FIG. 3A.

As described with reference to FIGS. 2 through 3B, the display panel 100 according to an exemplary embodiment of the present inventive concept may include the zeroth transistor T0 which provides the third voltage Vint to the first data line D1 and may initialize the first pixel 211 in the data period Td (e.g., when the second data signal DATA2 is distributed to the second data line D1) using the zeroth transistor T0. Therefore, a writing time for some pixels (e.g., the second pixel 212) may increase, but a stain due to a shortness of the writing time will be reduced (or, eliminated).

Figure 4:
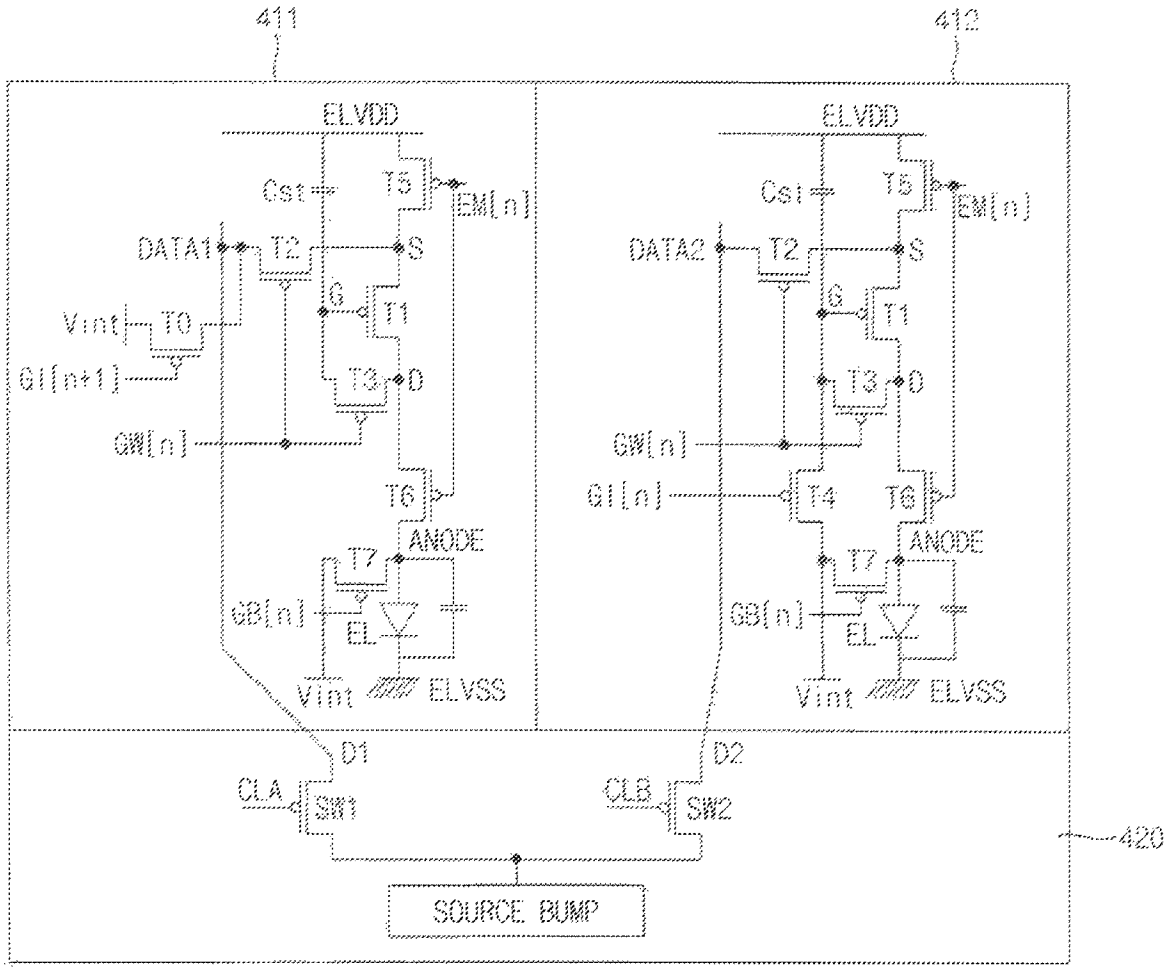
FIG. 4 is a circuit diagram illustrating the display panel of FIG. 1 according to an exemplary embodiment of the present inventive concept.

FIG. 4 is a circuit diagram illustrating the display panel of FIG. 1 according to an exemplary embodiment of the present inventive concept.

Referring to FIGS. 1, 2, and 4, the display panel 100 may include a first pixel 411, a second pixel 412, and a distributor 420. The second pixel 412 and the distributor 420 may be the same as or substantially the same as the second pixel 212 and the distributor 120 described with reference to FIG. 2. Therefore, a duplicated description will not be provided.

The first pixel 411 may be the same as the first pixel 211 except for the fourth transistor T4 illustrated in FIG. 2. As illustrated in FIG. 4, the first pixel 411 may not include the fourth transistor T4 described with reference to FIG. 2.

In this case, the first pixel 411 may initialize the first previous data signal in only the first period T1 (or before the second period T2) of the data period Td instead of the initialization period Ti.

Because the first pixel 411 do not include the fourth transistor T4, the first pixel 411 may have a pixel structure which is simpler than a pixel structure of the first pixel 211 illustrated in FIG. 2, and thus, a manufacturing cost of the display panel 100 may decrease.

Figure 5:
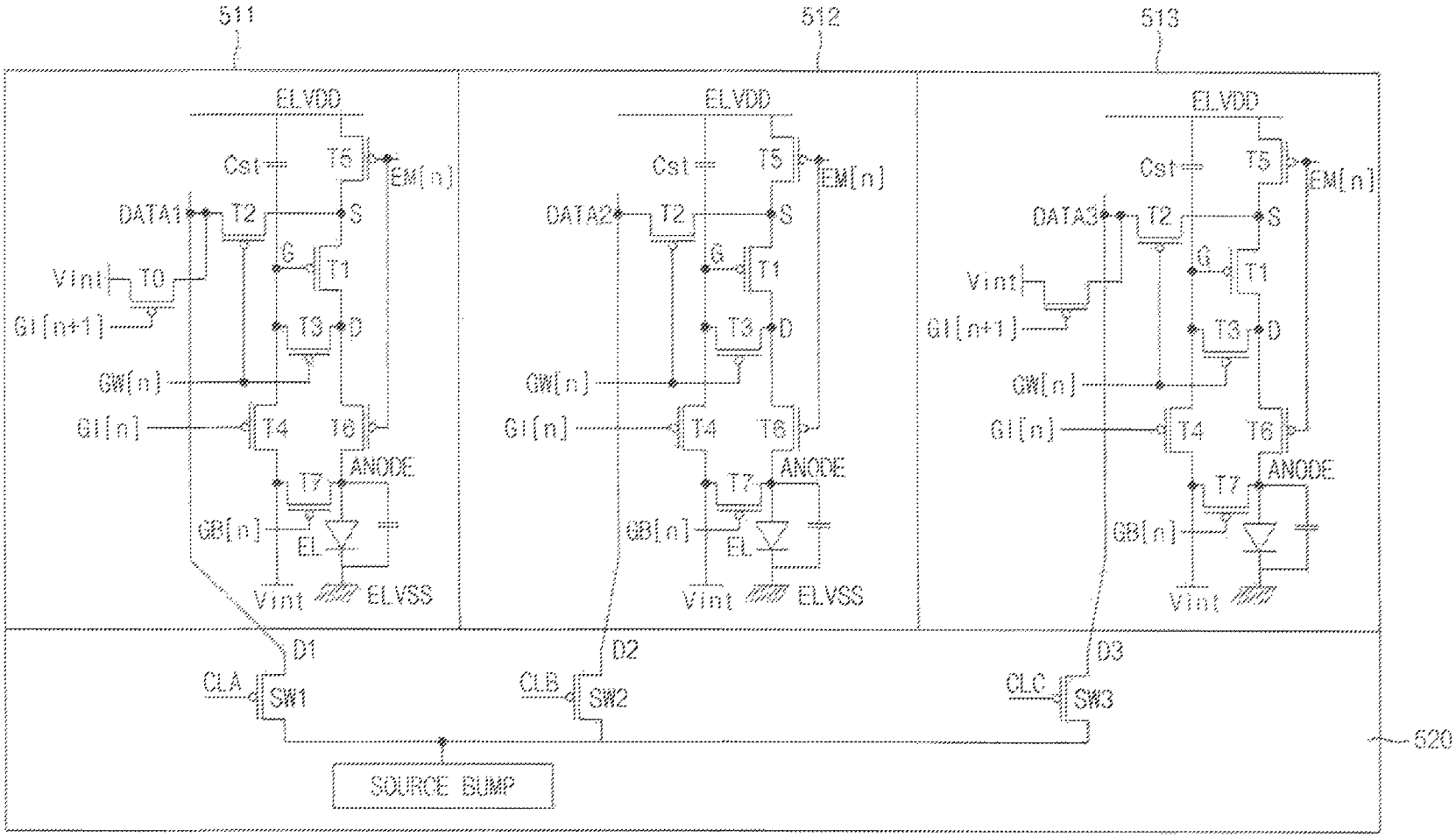
FIG. 5 is a circuit diagram illustrating the display panel of FIG. 1 according to an exemplary embodiment of the present inventive concept.

FIG. 5 is a circuit diagram illustrating the display panel of FIG. 1 according to an exemplary embodiment of the present inventive concept.

Referring to FIGS. 1 and 5, the display panel 100 illustrated in FIG. 1 may include pixels P11 through Pnm which are arranged in a matrix form. A row of the pixels P11 through Pnm may be arranged in a stripe form. For example, the eleventh pixel P11 may emit light with a first color (e.g., a red color), the twelfth pixel P12 may emit light with a second color (e.g., a green color), the thirteenth pixel P13 may emit light with a third color (e.g., a blue color). This sequence may be repeated in a row to form a row of a pentile structure, for example. In other words, a pixel which emits light with the first color is arranged in a first pixel column (e.g., a pixel column connected to the first data line D1), a pixel which emits light with the second color is arranged in a second pixel column (e.g., a pixel column connected to the second data line D2), and a pixel which emits light with the third color is arranged in a third pixel column (e.g., a pixel column connected to the third data line D3). Hereinafter, pixels included in a 3M+1th pixel column (e.g., the eleventh pixel P11, the twenty-first pixel P21, etc.) are referred to as a third pixel, pixels included in a 3M+2th pixel column (e.g., the twelfth pixel P12, a twenty-second pixel P22, etc.) are referred to as a fourth pixel, and pixels included in a 3M+3th pixel column (e.g., the thirteenth pixel P13, the twenty-third pixel P23, etc.) are referred to as a fifth pixel. M is an integer greater than 0, for example.

The third pixel 511 and the fifth pixel 513 may be the same as or substantially the same as the first pixel 211 described with reference to FIG. 2, and the fourth pixel 512 may be the same as or substantially the same as the second pixel 212 described with reference to FIG. 2. Therefore, a duplicate description will not be provided. The third through fifth pixels 511, 512, and 513 are not limited thereto. For example, the third pixel 511 and the fifth pixel 513 may have a pixel structure which is the same as a pixel structure of the first pixel 411 illustrated in FIG. 4.

The distributor 520 may further include a third switch SW3. The third switch SW3 may be electrically connected between the source bump SOURCE BUMP and the third data line D3 and may transfer a third data signal DATA3 to the third data line D3 in response to a third switch control signal CLC.

Figure 6:
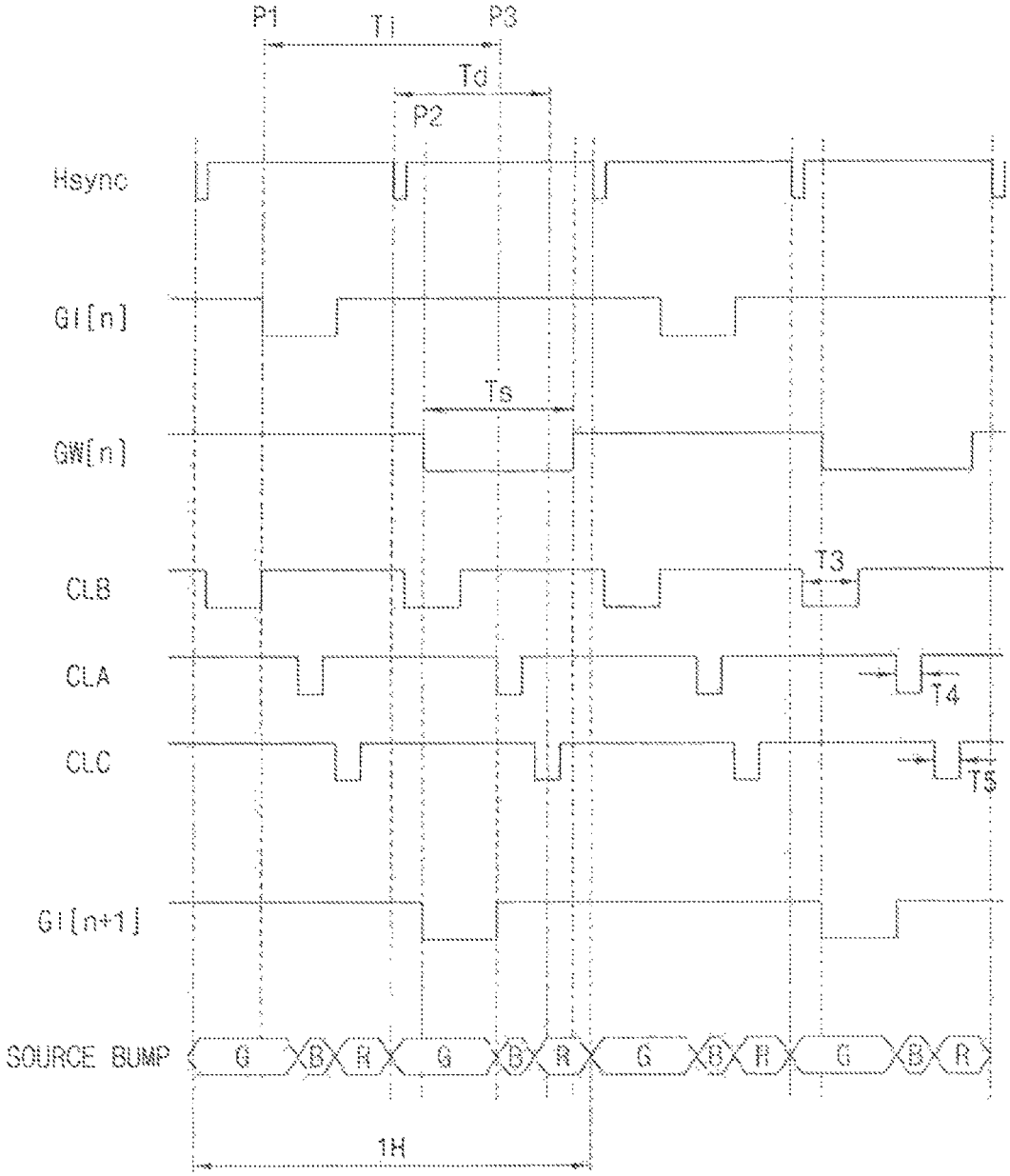
FIG. 6 is a waveform diagram illustrating signals provided to the display panel of FIG. 5 according to an exemplary embodiment of the present inventive concept.

FIG. 6 is a waveform diagram illustrating an inventive technique of signals provided to the display panel of FIG. 5.

Referring to FIGS. 3B, 5, and 6, a synchronization signal Hsync, an Nth gate signal GI[n], a scan signal GW[n], and an N+1th gate signal GI[n+1] which are illustrated in FIG. 6 may be the same as the synchronization signal Hsync, the Nth gate signal GI[n], the scan signal GW[n], and the N+1th gate signal GI[n+1] which are described with reference to FIG. 3B, respectively. Therefore, a duplicate description will not be provided.

The Nth gate signal GI[n] may be changed to have a logic low level (e.g., a turn-on voltage level, or a low voltage level) at a first time point P1 and may be changed to have a logic high level (e.g., a turn-off voltage level, or a high voltage level) before the data period Td is started.

Here, the third through fifth pixels 511, 512, and 513 may initialize previous data signals in response to the Nth gate signal GI[n].

In the data period Td, a second switch control signal CLB, a first switch control signal CLA, and the third switch control signal CLC may have the logic low level. The second switch control signal CLB may have the logic low level in a third period T3 (e.g., a front or beginning period) of the data period Td, the first switch control signal CLA may have the logic low level in a fourth period T4 (or, a middle period) of the data period Td, and the third switch control signal CLC may have the logic low level in a fifth period T3 (e.g., a rear or end period) of the data period Td.

In this case, the distributor 520 may transfer the second data signal DATA2 to the second data line D2 in the third period T3, may transfer the first data signal DATA1 to the first data line D1 in the fourth period T4, and may transfer the third data signal DATA3 to the third data line D3 in the fifth period T5.

In the scan period Ts, the fourth pixel 512 may store the second data signal DATA2 transferred through the second data line D2. Similarly, the third pixel 511 may store a signal of the first data line D1, and the fifth pixel 513 may store a signal of the third data line D3.

As illustrated in FIG. 6, the N+1th gate signal GI[n+1] may have the logic low level from the second time point P2 to the third time point P3, the zeroth transistor T0 of the third pixel 511 may be turned on, and the third voltage Vint may be provided to the first data line D1. Similarly, the zeroth transistor T0 of the fifth pixel 513 may be turned on, and the third voltage Vint may be provided to the third data line D3. Therefore, even though the scan signal GW[n] has the logic low level, the third pixel 511 and the fifth pixel 513 may not store the first previous data signal and may initialize the previous data signals using the third voltage Vint provided through the zeroth transistor T0.

After the third time point P3, the first switch control signal CLA may have the logic low level during the fourth period T4 of the data period Td, the distributor 520 may transfer the first data signal DATA1 to the first data line D1, and the third pixel 511 may store the first data signal DATA1 in response to the scan signal GW[n] having the logic low level.

Similarly, the third switch control signal CLC may have the logic low level during the fifth period T5 of the data period Td, the distributor 520 may transfer the third data signal DATA3 to the third data line D3, and the fifth pixel 513 may store the third data signal DATA3 in response to the scan signal GW[n] having the logic low level.

As described with reference to FIGS. 5 and 6, the display panel 100 according to an exemplary embodiment of the present inventive concept may include the zeroth transistor T0 which provides the third voltage Vint to the first data line D1 and the third data line D3 and may initialize the third pixel 511 and the fifth pixel 513 using the zeroth transistor T0 in the data period Td (e.g., when the second data signal DATA2 is distributed to the second data line D2). Therefore, a writing time for some pixels (e.g., the fourth pixel 514) may increase, but a stain due to a shortening of the writing time will not be present.

Figure 7:
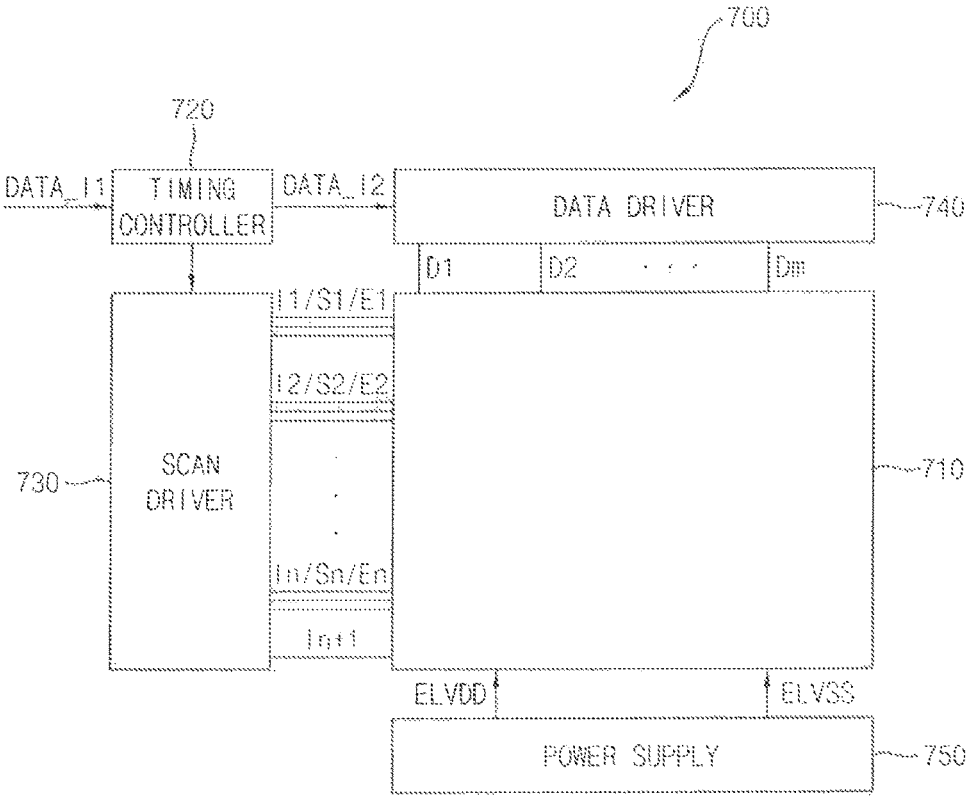
FIG. 7 is a block diagram illustrating a display device according to an exemplary embodiment of the present inventive concept.

FIG. 7 is a block diagram illustrating a display device according to an exemplary embodiment of the present inventive concept.

Referring to FIG. 7, a display device 700 may include a display panel 710, a timing controller 720, a scan driver 730, a data driver 740, and a power supply 750. The display device 700 may display an image based on input data (e.g., first data DATA_I1). For example, the display device 700 may be an organic light emitting display device.

The display panel 710 may be the same as or substantially the same as the display panel 100 described with reference to FIG. 1. Therefore, a duplicate description will not be provided.

As described with reference to FIGS. 1, 2, and 5, the display panel 710 may include pixels P11 through Pnm which are arranged in a pentile form or in a stripe form.

The timing controller 720 may convert the input data to be used by the data driver 740 and may control the scan driver 730 and the data driver 740. For example, the timing controller 720 may generate a gate driving control signal and may provide the gate driving control signal to the scan driver 720. For example, the timing controller 720 may generate a data driving control signal and may provide converted data (e.g., second data DATA_I2) and the data driving control signal to the data driver 740. In addition, the timing controller 720 may generate and provide the first and second switch control signals CLA and CLB to the display panel 710.

The scan driver 730 may generate a scan signal and a control signal (e.g., a gate signal) based on the gate driving control signal. The gate driving control signal may include a start signal (e.g., a start pulse) and clock signals, and the scan driver 730 may include gate driving units (e.g., shift registers) sequentially generating the scan signal and/or the control signal based on the start signal and the clock signals.

In addition, the scan driver 730 may generate a light emission control signal based on a diming control signal DL (or a light emission driving control signal) and may provide the light emission control signal to the display panel 710 through light emission control lines E1 through En. Each of the pixels P11 through Pnm may emit no light in response to the light emission control signal having a logic high level and may emit light in response to the light emission control signal having a logic low level.

The data driver 130 may generate data signals corresponding to the converted data (e.g., the second data DATA_I2) using reference gamma voltages and may provide the data signals to the display panel 710 through output lines O1 through Ok. The display panel 710 (or, the display device 700) includes distributor (e.g., a demultiplexer), and the data driver 740 may sequentially output some data signals (e.g., first through third data signals) to a certain output line (e.g., a first output line O1).

The power supply 750 may generate a driving voltage to drive the display device 700. The driving voltage may include a first power voltage ELVDD and a second power voltage ELVSS.

The data driver 130 may provide the display panel 110 with the data signals in response to the data driving control signal.

Figure 8:
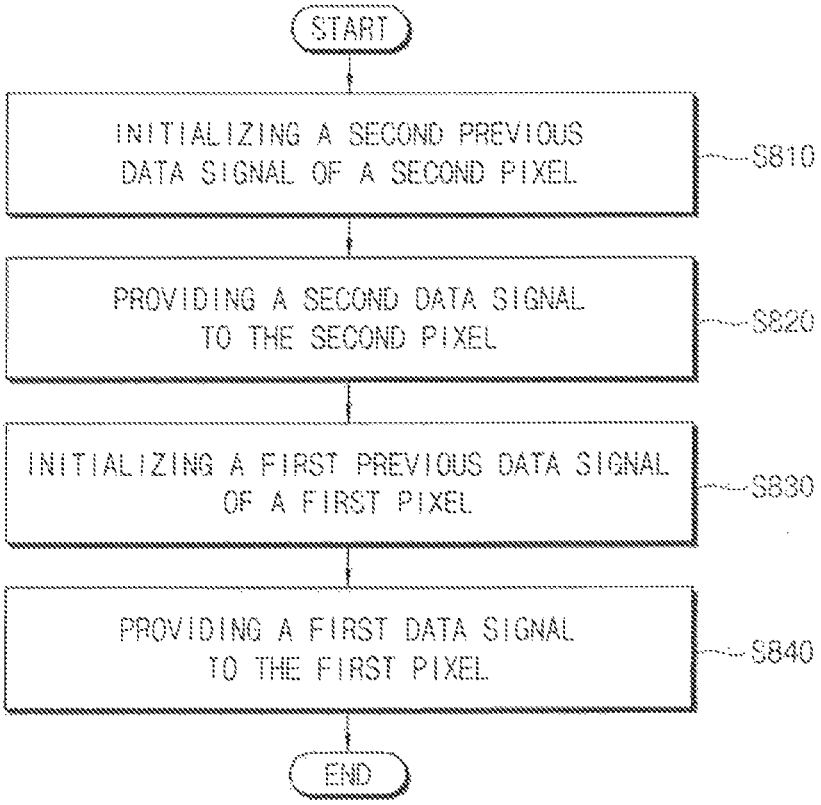
FIG. 8 is a flow diagram illustrating a method of driving a display panel according to an exemplary embodiment of the present inventive concept.

FIG. 8 is a flow diagram illustrating a method of driving a display panel according to an exemplary embodiment of the present inventive concept.

Referring to FIGS. 1, 2, 3B, 7, and 8, the method of FIG. 8 may be performed by the display device 700 of FIG. 7 and may drive the display panel 100 of FIG. 1.

The method of FIG. 8 may initialize the second previous data signal of the second pixel 212 (S810). The method of FIG. 8 may provide the second pixel 212 with a second control signal (e.g., the Nth gate signal GI[n]) having the logic low level (e.g., a turn-on voltage level) in the initialization period Ti. Here, the fourth transistor T4 of the second pixel 212 may be turned on in response to the second control signal (e.g., the Nth gate signal GI[n]), and the second previous data signal stored in the storage capacitor Cst of the second pixel 212 may be initialized (or, removed) by the third voltage Vint.

In an exemplary embodiment of the present inventive concept, the method of FIG. 8 may initialize the first previous data signal of the first pixel 211 in the initialization period Ti. The first pixel 211 illustrated in FIG. 2 may also include the fourth transistor T4. The fourth transistor T4 of the first pixel 211 may be turned on in response to the second control signal (e.g., the Nth gate signal GI[n]) having the logic low level (e.g., a turn-on voltage level), and the first previous data signal stored in the storage capacitor Cst of the first pixel 211 may be initialized (or, removed) by the third voltage Vint.

The method of FIG. 8 may provide the second data signal DATA2 to the second pixel 212 using the distributor 120 (S820). The method of FIG. 8 may provide the distributor 120 with the second switch control signal CLB having the logic low level in the first period T1 of the data period Td. Here, the second switch SW2 may be turned on in response to the second switch control signal and may transfer the second data signal DATA2 to the second data line D2.

The method of FIG. 8 may store the second data signal DATA2 in the second pixel 212. The method of FIG. 8 may provide the second pixel 212 with the scan signal GW[n] having the logic low level in the scan period Ts. Here, the second transistor T2 (and the third transistor T3) of the second pixel 212 may be turned on in response to the scan signal GW[n], and the second data signal DATA2 of the second data line D2 may be stored in the storage capacitor Cst of the second pixel 212.

In an exemplary embodiment of the present inventive concept, the method of FIG. 8 may provide the first pixel 211 and the second pixel 212 with the scan signal GW[n] having the logic low level while the second data signal DATA2 is provided to the second pixel 212. As described above with reference to FIG. 3B, the scan signal GW[n] may be changed to have the logic low level at the second time point P2.

Because the scan signal GW[n] having the logic low level is also provided to the first pixel 211, a signal of the second data line D2 (e.g., the first previous data signal) may be stored in the storage capacitor Cst of the first pixel 211.

However, the method of FIG. 8 may initialize the first previous data signal of the first pixel 211 when the second data signal DATA2 is stored in the second pixel 212 (S830). For example, the method of FIG. 8 may provide the first pixel 211 with a second control signal (e.g., the N+1th gate signal GI[n+1]) having the logic low level at a start point of the scan period Ts. Here, the zeroth transistor T0 of the first pixel 211 may be turned on in response to the second control signal (e.g., the N+1th gate signal GI[n+1]), and the third voltage Vint may be provided to the first data line D1. Because the second transistor T2 (and the third transistor T3) of the first pixel 211 may be turned on in response to the scan signal GW[n], the third voltage Vint provided to the first data line D1 may be stored in the storage capacitor Cst of the first pixel 211. In other words, the method of FIG. 8 may initialize the first previous data signal, which was left in the first data line D1 and stored in the first pixel 211, by providing the first pixel 211 with the second control signal (e.g., the N+1th gate signal GI[n+1]) having the logic low level at the start point of the scan period Ts.

The method of FIG. 8 may provide the first data signal DATA1 to the first pixel 211 using the distributor 120 (S840). The method of FIG. 8 may change the second control signal (e.g., the N+1th gate signal GI[n+1]) to have the logic high level when the first period T1 of the data period Td is finished and may provide the distributor 120 with the first switch control signal CLA having the logic low level in the second period T2 of the data period Td. In this case, the first switch SW1 may be turned on in response to the first switch control signal CLA and may transfer the first data signal DATA1 to the first data line D1.

Because the scan signal GW[n] has the logic low level, the second pixel 212 may store the second data signal DATA2. The second data signal DATA2 of the second data line D2 may be stored in the storage capacitor Cst of the second pixel 212 because the second transistor T2 (and the third transistor T3) of the second pixel 212 are kept in a turn-on state by the scan signal GW[n].

As described above, the method of driving the display panel according to an exemplary embodiment of the present inventive concept may initialize the first pixel 211 using the zeroth transistor T0 in the data period Td (e.g., while the second data signal is distributed to the second data line D2 and while the second data signal DATA2 is stored in the second pixel 212). Therefore, a writing time for some pixels (e.g., the second pixel 212) may increase, but a stain due to a short writing time will be removed (or, eliminated).

Exemplary embodiments of the present inventive concept may be applied to any display device (e.g., an organic light emitting display device, a liquid crystal display device, etc). For example, exemplary embodiments of the present inventive concept may be applied to a television, a computer monitor, a laptop, a digital camera, a cellular phone, a smart phone, a personal digital assistant (PDA), a portable multimedia player (PMP), an MP3 player, a navigation system, a video phone, etc.

While the present inventive concept has been particularly shown and described with reference to exemplary embodiments thereof, it will be apparent to those of ordinary skill in the art that various changes in form and detail may be made thereto without departing from the spirit and scope of the present inventive concept as defined by the following claims.

What is claimed is:

1. A display panel, comprising:

a distributor configured to transfer a second data signal to a second data line in a first period of a data period and to transfer a first data signal to a first data line in a second period of the data period, wherein the second period is different from the first period;

a first pixel electrically connected to the first data line, configured to initialize a first previous data signal in the data period in response to a first control signal, and configured to store the first data signal in the second period in response to a scan signal; and a second pixel electrically connected to the second data line and configured to store the second data signal in the first period in response to the scan signal, wherein the first pixel includes a transistor directly connected to the first data line and a first voltage and configured to be turned on in response to the first control signal, wherein the first control signal is an N+1th gate signal, where N is a positive integer, wherein the first pixel and the second pixel are included in an Nth pixel row, and wherein the first control signal corresponds to an N+1th pixel row adjacent to the Nth pixel row.

2. The display panel of claim 1, wherein the first pixel further includes:

a first light emitting element;

a first storage capacitor;

a second transistor for transferring a signal of the first data line to the first storage capacitor in response to the scan signal; and a first transistor for controlling an amount of a first current provided to the first light emitting element with a voltage in the first storage capacitor.

3. The display panel of claim 2, wherein the second pixel includes:

a second light emitting element;

a second storage capacitor;

a fourth transistor electrically connected between a terminal of the second storage capacitor and the first voltage and configured to be turned on in response to a second control signal;

a fifth transistor for transferring the second data signal to the second storage capacitor in response to the scan signal; and a sixth transistor for controlling an amount of a second current provided to the second light emitting element with a voltage in the second storage capacitor.

4. The display panel of claim 3, wherein the second control signal is provided to the second pixel at a first time point which is earlier than the data period, wherein the scan signal is provided to the first pixel and the second pixel at a second time point which is later than a start point of the first period, wherein the first control signal is provided to the first pixel from the second time point to a third time point, and wherein the third time point is earlier than the second period.

5. The display panel of claim 4, wherein the data period includes the second time point.

6. The display panel of claim 3, wherein the fourth transistor is turned on in an initialization period in response to the second control signal, and wherein the initialization period is different from the data period.

7. The display panel of claim 3, wherein the distributor includes:

a source bump configured to receive the first data signal and the second data signal from an external component;

a first switch electrically connected between the source bump and the first data line and configured to be turned on in the second period in response to a first switch control signal; and a second switch electrically connected between the source bump and the second data line and configured to be turned on in the first period in response to a second switch control signal.

8. The display panel of claim 3, wherein the first pixel further includes:

a seventh transistor electrically connected between a terminal of the first storage capacitor and the first voltage and configured to be turned on in response to the second control signal.

9. The display panel of claim 1, further comprising:

a third pixel electrically connected to a third data line, configured to initialize a third previous data signal in the data period in response to the first control signal, and configured to store a third data signal in a third period of the data period in response to the scan signal, wherein the third period is different from the first period and the second period, and, wherein the distributor transfers the third data signal to the third data line in the third period.

10. The display panel of claim 9, wherein the third pixel includes:

a third light emitting element;

a third storage capacitor;

a transistor electrically connected between the third data line and the first voltage and configured to be turned on in response to the first control signal;

a first transistor for transferring a signal of the third data line to the third storage capacitor in response to the scan signal; and a second transistor for controlling an amount of a third current provided to the third light emitting element with a voltage in the third storage capacitor.

11. The display panel of claim 10, wherein the scan signal is provided to the first pixel and the second pixel at a second time point which is later than a start point of the first period, wherein the first control signal is provided to the first pixel from the second time point to a third time point, and wherein the third time point is earlier than the second period.

12. The display panel of claim 9, wherein the third pixel is included in the Nth pixel row.

13. A display panel, comprising:

a first pixel electrically connected to a first data line and including a transistor having a first electrode connected to the first data line, a second electrode connected to a voltage and a gate electrode connected to an N+1 gate signal line, wherein N is a positive integer; and a second pixel electrically connected to a second data line and configured to store a second data signal provided via the second data line in a first period of a data period in response to a scan signal, wherein the first pixel is configured to be initialized in the data period in response to a control signal provided to the gate electrode of the transistor via the N+1 gate signal line, and store a first data signal provided via the first data line in a second period of the data period in response to the scan signal, wherein the first period of the data period occurs before a scan period starts and the second period of the data period occurs before the scan period ends.

14. The display panel of claim 13, further comprising a distributor configured to provide the first and second data signals to the first and second pixels.

15. The display panel of claim 14, wherein the distributor includes a demultiplexer.

16. The display panel of claim 13, wherein the first period of the data period occurs before the second period of the data period.

17. The display panel of claim 13, wherein the data period is overlapped with an initialization period and a scan period.

18. The display panel of claim 13, wherein the scan period begins when the control signal is provided to the gate electrode of the transistor.

19. The display panel of claim 13, wherein the first and second pixels are arranged in a first row, and the control signal is a gate signal of a second row adjacent to the first row.

20. The display panel of claim 13, wherein data previously stored in the first pixel is removed when the first pixel is initialized.

21. A method of driving a display panel which includes a first pixel, a second pixel, and a distributor for sequentially providing first and second data signals to the first and second pixels, the method comprising:

initializing the second pixel in response to a second control signal;

providing the second data signal to the second pixel using the distributor;

initializing the first pixel in response to a first control signal and a scan signal in response to the second data signal being provided to the second pixel; and providing the first data signal to the first pixel using the distributor, wherein the first pixel includes a transistor directly connected to a first data line and a first voltage and configured to be turned on in response to the first control signal, wherein the first control signal is an N+1th gate signal, where N is a positive integer, wherein the first pixel and the second pixel are included in an Nth pixel row, and wherein the first control signal corresponds to an N+1th pixel row adjacent to the Nth pixel row.

22. The method of claim 21, wherein the first pixel is pre-initialized while the second pixel is initialized.

23. The method of claim 21, wherein the scan signal is provided to the first pixel and the second pixel when the second data signal is provided to the second pixel.

* * * * *